US011064734B2

(12) United States Patent
Lin

(10) Patent No.: US 11,064,734 B2
(45) Date of Patent: Jul. 20, 2021

(54) DISPENSING BOX HOLDER

(71) Applicant: REPUBLIC TOBACCO L.P., Glenview, IL (US)

(72) Inventor: Mei Lin, Northbrook, IL (US)

(73) Assignee: REPUBLIC TOBACCO L.P., Glenview, IL (US)

( * ) Notice: Subject to any disclaimer, the term of this patent is extended or adjusted under 35 U.S.C. 154(b) by 0 days.

(21) Appl. No.: 16/590,125

(22) Filed: Oct. 1, 2019

(65) Prior Publication Data

US 2021/0092997 A1 Apr. 1, 2021

(51) Int. Cl.

| | |
|---|---|
| ***A24F 15/06*** | (2006.01) |
| ***B65D 25/10*** | (2006.01) |
| ***B65D 25/24*** | (2006.01) |
| ***B65D 25/52*** | (2006.01) |

(52) U.S. Cl.

CPC ..... *A24F 15/06* (2013.01); *B65D 25/10* (2013.01); *B65D 25/24* (2013.01); *B65D 25/52* (2013.01)

(58) Field of Classification Search

CPC ..... B65D 25/10; B65D 25/24; B65D 25/52; A24F 15/06; A24F 15/04; A47F 1/00

USPC ..... 221/282; 312/42

See application file for complete search history.

(56) References Cited

U.S. PATENT DOCUMENTS

| | | | | | |
|---|---|---|---|---|---|
| 601,798 | A | | 4/1898 | Slomka | |
| 1,783,149 | A | * | 11/1930 | Jantzen | A47K 10/24 221/34 |
| D89,883 | S | | 5/1933 | Fried | |
| 2,257,536 | A | * | 9/1941 | Roycroft | A47F 3/14 211/126.1 |
| 2,268,873 | A | * | 1/1942 | Hopkins | A47F 1/10 221/242 |
| D140,246 | S | | 2/1945 | Wemyss | |
| D140,748 | S | | 4/1945 | Goldbert | |
| D159,687 | S | | 8/1950 | Silverman | |
| D199,884 | S | | 12/1964 | Wayman | |
| 3,301,388 | A | * | 1/1967 | Rockwell | B65D 83/00 312/42 |
| 3,403,815 | A | * | 10/1968 | Robson | B65D 83/0805 221/34 |
| 3,814,301 | A | * | 6/1974 | Niepmann | B65D 85/1036 229/233 |

(Continued)

FOREIGN PATENT DOCUMENTS

| | | | |
|---|---|---|---|
| CN | 205885072 | U | 1/2017 |
| WO | 2012084681 | A1 | 6/2012 |

OTHER PUBLICATIONS

Wall Control "9IN Deep Slotted Metal Pegboard Shelf Divider Pair—10-DV-009", <https://www.wallcontrol.com/9in-deep-slotted-metal-pegboard-shelf-divider-pair-white/>, website publicly available at least as early as Jul. 9, 2018.

(Continued)

*Primary Examiner* — Rakesh Kumar

(74) *Attorney, Agent, or Firm* — Michael Best & Friedrich LLP

(57) ABSTRACT

A dispensing box holder includes a base, a plurality of walls, and a retainer member. Each of the plurality of walls extends from the base. A dispensing opening is defined in at least one of the walls. The retainer member is removably received on the base. A box receiving area is defined by the base, the plurality of walls, and the retainer member. The retainer member defines two sides of the box receiving area.

21 Claims, 5 Drawing Sheets

(56) References Cited

U.S. PATENT DOCUMENTS 3,857,364 A * 12/1974 Miller, Jr. ..... A01K 15/02 119/417
3,880,390 A * 4/1975 Niven ..... A47F 5/0815 248/220.43
4,037,756 A * 7/1977 Jaquish ..... A47F 1/08 221/242
4,164,312 A 8/1979 Harned
4,165,753 A 8/1979 Styker
D268,368 S 3/1983 Moss
D296,725 S 7/1988 Iacovelli
4,964,528 A 10/1990 Wagoner
5,080,023 A * 1/1992 Miura ..... B65D 19/44 108/55.3
5,149,032 A 9/1992 Jones et al.
5,295,592 A * 3/1994 Thorne ..... A47F 1/08 211/59.2
5,457,745 A 10/1995 Wang
5,860,517 A * 1/1999 Gemma, Jr. ..... B65D 5/327 206/63.3
5,957,280 A * 9/1999 Focke ..... B65D 5/549 206/264
6,012,593 A 1/2000 Knittel et al.
6,015,071 A 1/2000 Adomeit et al.
6,406,107 B1 * 6/2002 Franczak ..... A47F 1/08 211/49.1
6,460,710 B1 10/2002 Dardashti
7,143,912 B2 12/2006 Caneba
7,380,894 B2 * 6/2008 Berger ..... A47B 88/994 312/348.3
8,016,139 B2 9/2011 Hanners et al.
8,118,586 B2 * 2/2012 Trebilcock ..... B21D 7/022 425/403
8,628,155 B1 * 1/2014 Nielson ..... A47B 88/988 312/212
8,978,925 B2 * 3/2015 Babikian ..... A47K 10/42 221/45
D741,541 S 10/2015 Liu
9,261,304 B2 * 2/2016 Tunzi ..... F25D 25/00
D756,560 S 5/2016 Ghiotti et al.
D756,561 S 5/2016 Ghiotti et al.
D756,562 S 5/2016 Ghiotti et al.
9,463,576 B2 * 10/2016 Hsu ..... E06B 9/266
D815,344 S 4/2018 Smith
10,214,342 B2 2/2019 Parcevaux
D881,719 S 4/2020 O'Neill
10,660,456 B2 * 5/2020 Snyder ..... A47F 1/10
10,787,289 B1 * 9/2020 Bellamah ..... B31B 50/25
2002/0023855 A1 * 2/2002 Cho ..... B25H 3/028 206/373
2003/0136688 A1 * 7/2003 Venable ..... B65D 5/725 206/242
2005/0150847 A1 7/2005 Hawkinson
2006/0163180 A1 7/2006 Rankin, VI et al.
2007/0262038 A1 * 11/2007 Harbison ..... A47J 47/16 211/162
2009/0039742 A1 * 2/2009 Ripley, Jr. ..... A47F 3/004 312/114
2009/0052809 A1 2/2009 Sampson
2010/0257908 A1 * 10/2010 Trebilcock ..... B21D 7/022 72/17.3
2011/0174833 A1 * 7/2011 Granger ..... B65D 83/0805 221/35
2012/0018503 A1 * 1/2012 Walling ..... B65D 5/725 229/122.1
2014/0021217 A1 * 1/2014 Chen ..... G07F 9/10 221/258
2014/0374288 A1 * 12/2014 Holford ..... B65D 85/1036 206/266

OTHER PUBLICATIONS

PandPal "One Size Fits All Tissue Box Cover", <https://www.amazon.com/PandPal-Preference-Angelsoft-RectangularAdjustable/dp/B01FLCPVNM/ref=sr_1_5?keywords=pandpal&qid=1571239733&sr=8-5>, publicly available at least as early as Sep. 29, 2016.
European Patent Office Extended Search Report for Application No. 20182351.5 dated Jan. 21, 2021 (9 pages).

* cited by examiner

DISPENSING BOX HOLDER

BACKGROUND

The present disclosure relates to a dispensing box holder, and more particularly to a cigarette tube dispensing box holder.

SUMMARY

In one aspect, a dispensing box holder includes a base, a plurality of walls, and a retainer member. Each of the plurality of walls extends from the base. A dispensing opening is defined in at least one of the walls. The retainer member is configured to be removably received on the base to define a box receiving area with the base, the plurality of walls, and the retainer member. The retainer member defines two sides of the box receiving area.

In another aspect, a dispensing box holder includes a base, a plurality of walls, and a retainer member. Each of the plurality of walls extends from the base. A space is defined by the base and the plurality of walls. The retainer member is configured to be adjustably disposed in the space to define a box receiving area with the base, the plurality of walls, and the retainer member. The box receiving area includes a dispensing corner and a retaining corner opposite the dispensing corner. A dispensing opening is defined in at least one of the walls of the plurality of walls. The dispensing opening is positioned at or adjacent the dispensing corner of the box receiving area. The retainer member is positioned adjacent the retaining corner of the box receiving area.

DETAILED DESCRIPTION

Figure 1:
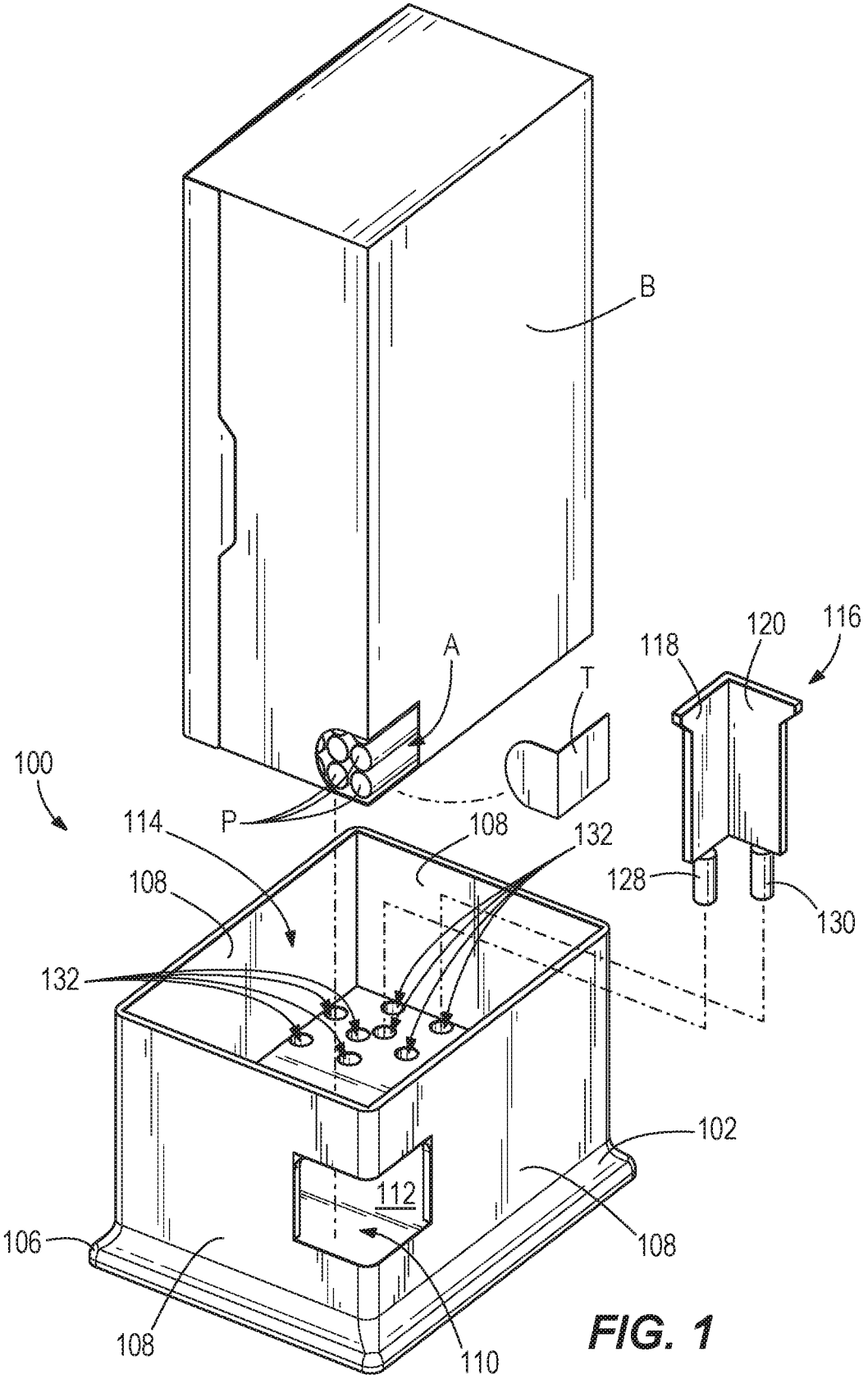
FIG. 1 is a top perspective view of an exemplary embodiment of a dispensing box holder with a retainer member exploded and a dispensing box exploded therefrom.

Before any embodiments of the disclosure are explained in detail, it is to be understood that the disclosure is not limited in its application to the details of construction and the arrangement of components set forth in the following description or illustrated in the drawings. The disclosure is capable of supporting other embodiments and of being practiced or of being carried out in various ways. Also, it is to be understood that the phraseology and terminology used herein is for the purpose of description and should not be regarded as limiting.

Figure 2:
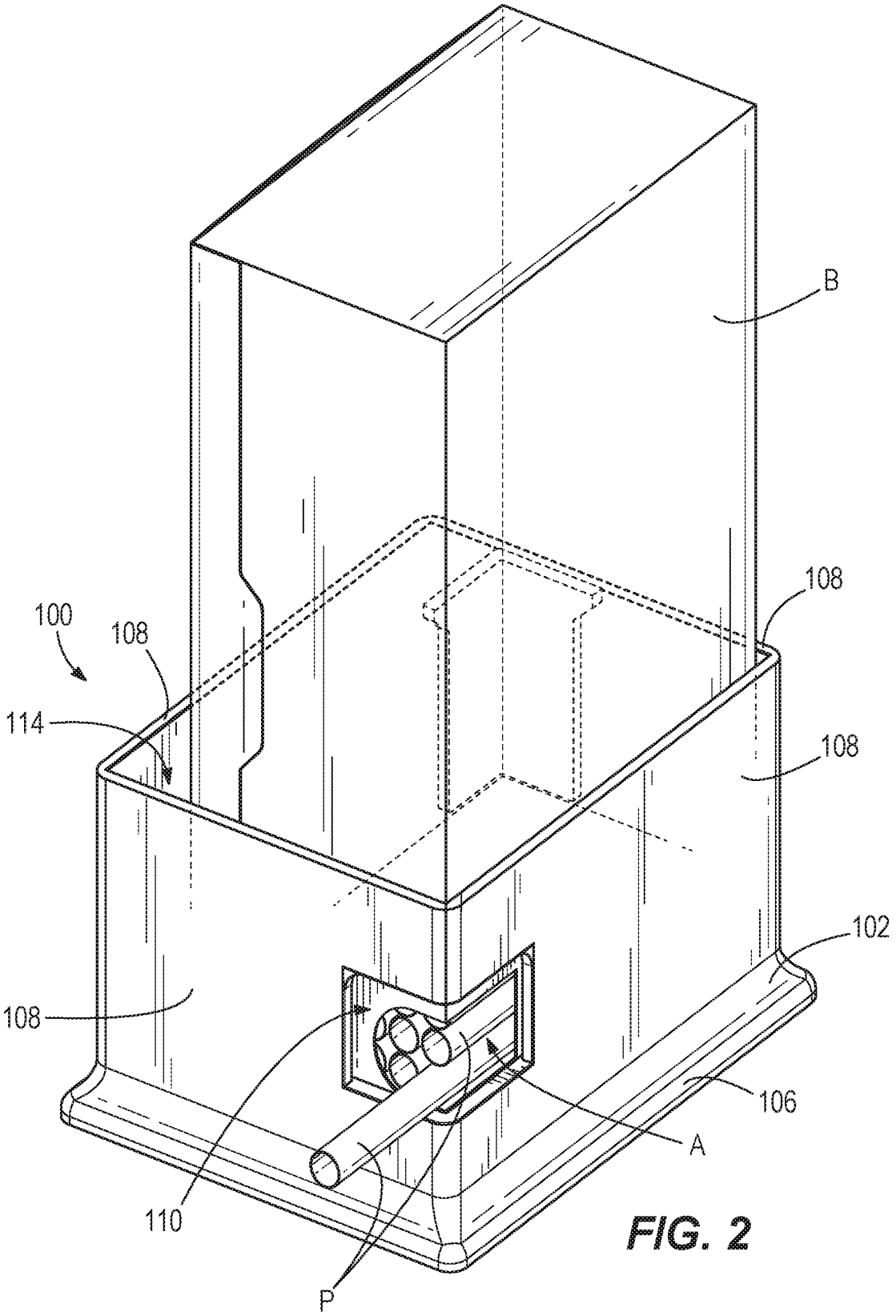
FIG. 2 is a top perspective view of the dispensing box holder of FIG. 1 with the dispensing box retained therein.

As shown in the exemplary embodiment of FIGS. 1 and 2, a dispensing box holder 100 removably receives one or more types of boxes B. Each box B may be filled with a product P to be dispensed to a user. The product P can be a plurality of paper cigarette tubes, cigarettes, candy, snacks, pens, pencils, nails, or the like.

Figure 3:
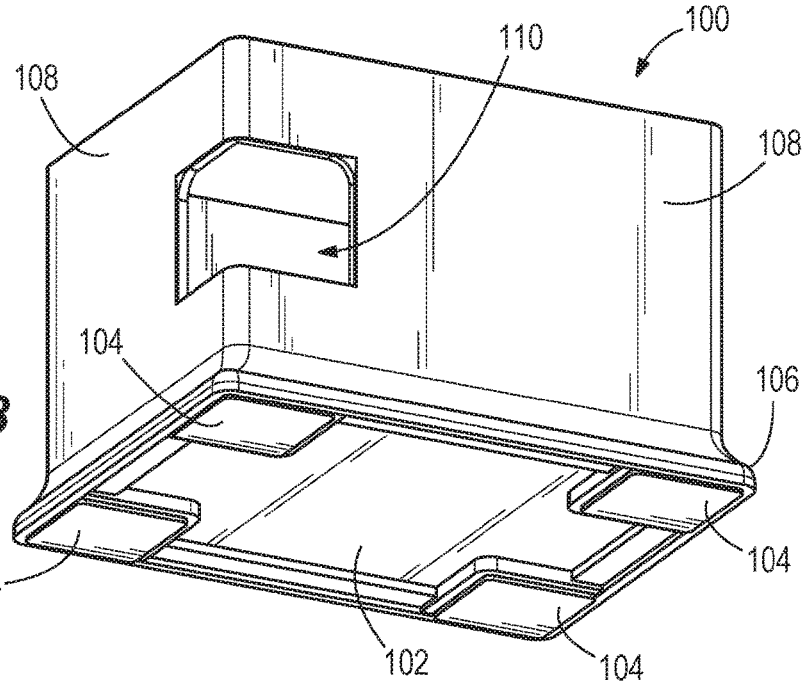
FIG. 3 is a bottom perspective view of the dispensing box holder of FIG. 1.
Figure 4:
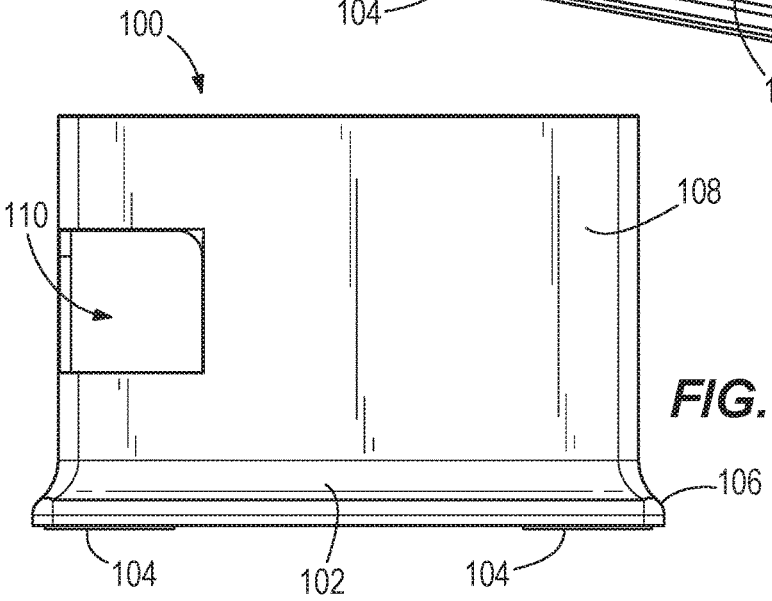
FIG. 4 is a side elevation view of the dispensing box holder of FIG. 1.
Figure 5:
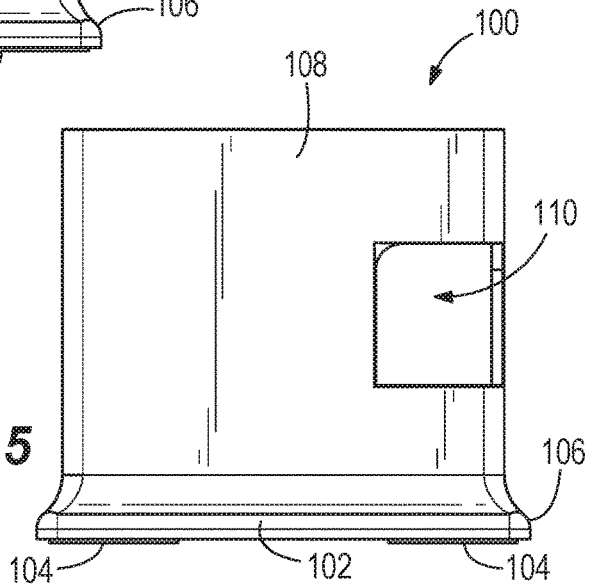
FIG. 5 is a front elevation view of the dispensing box holder of FIG. 1.

As shown in FIGS. 3-5, the holder 100 includes a base 102. The base 102 may be weighted in some embodiments to reduce the likelihood of the holder 100 tipping over. In the illustrated embodiment, the base 102 includes a plurality of feet 104. The feet 104 may include rubber or another resilient material to prevent scratching a support surface on which the holder 100 may be placed (e.g., a table). Further, the feet 104 may be configured to reduce the likelihood of the holder 100 sliding along the surface. In the illustrated embodiment, the base 102 also includes a widened portion 106, which may further reduce the likelihood of the holder 100 tipping over.

The holder 100 further includes a plurality of walls 108 extending from the base 102. In the illustrated embodiment, the walls 108 are connected to each other. In the illustrated embodiment, the holder 100 includes four walls 108, but other embodiments may include two, three, five, or more than five walls 108. A dispensing opening 110 is defined in at least one of the walls 108. In the illustrated embodiment, the dispenser opening 110 is defined in two adjacent walls 108 to form a corner dispenser opening 110. As shown in FIG. 2, the dispenser opening 110 is positioned such that it lines up with an aperture A of the product box B once the product box B has been positioned in the holder 100. The aperture A may be formed by removing a tab T from the product box B.

Figure 6:
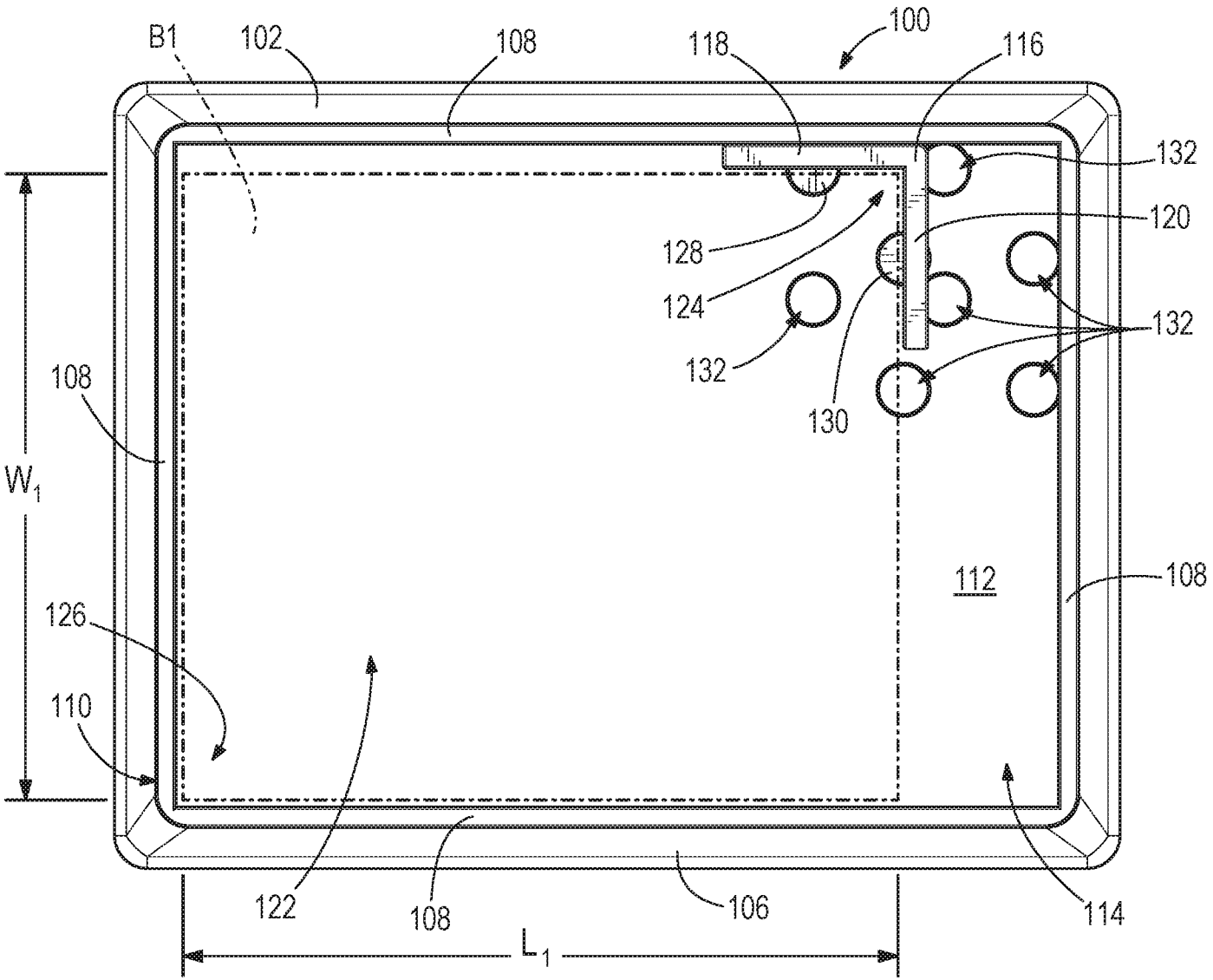
FIG. 6 is a top plan view of the dispensing box holder of FIG. 1 with the retainer member in a first position.
Figure 7:
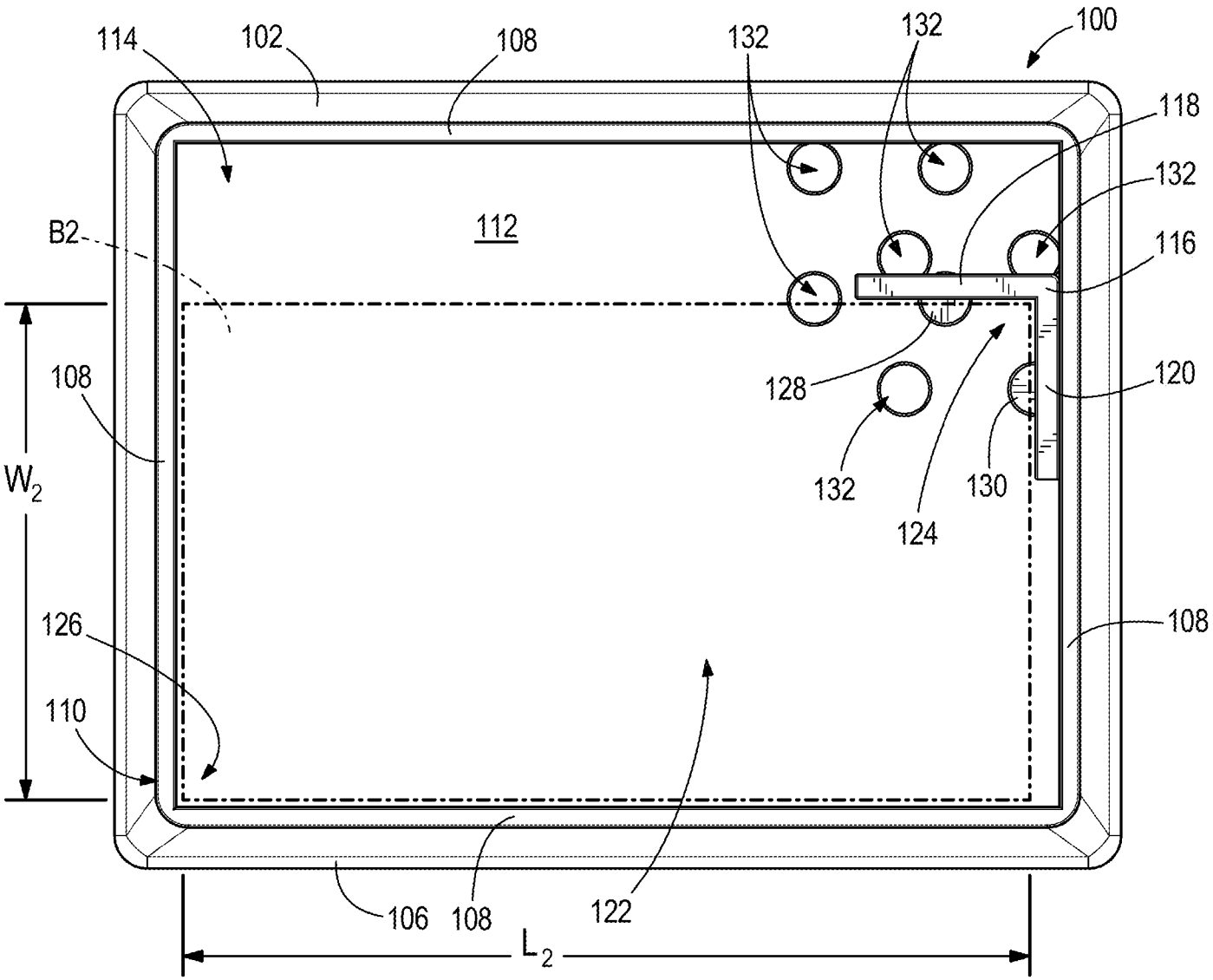
FIG. 7 is a top plan view of the dispensing box holder of FIG. 1 with the retainer member in a second position.

As shown in FIGS. 1, 6, and 7, the base 102 further includes an interior support surface 112 configured to receive the product box B. In the illustrated embodiment, the support surface 112 is parallel with the bottom of the base 102, but other embodiments may include an inclined support surface 112 to aid in dispensing the product P. As shown in FIG. 1, the support surface 112 and the walls 108 define an interior space 114. The space 114 has an open end opposite the base 102.

As shown in FIG. 1, the holder 100 further includes a retainer member 116. The retainer member 116 is disposed in the space 114. In the illustrated embodiment, the retainer member 116 is received on the base 102 in an adjustable manner. The retainer member 116 includes a first retaining panel 118 and a second retaining panel 120. In the illustrated embodiment, the first retaining panel 118 and the second retaining panel 120 are connected to each other directly to form an L-shape (as shown in FIGS. 6 and 7). Other embodiments may include a retainer member 116 of other various sizes and/or shapes. In some embodiments, the retainer member 116 is configured to engage two sides of the product box B. Other embodiments may include multiple retainer members 116 that cooperate to engage one or more sides of the product box B.

As shown in FIGS. 6 and 7, the retainer member 116, the support surface 112, and the walls 108 define a box receiving area 122 (outlined in phantom lines) within the space 114. In the illustrated embodiment having four walls 108, only two of the walls 108 define the box receiving area 122 along with the retainer member 116 and the support surface 112. The size and shape of the box receiving area 122 can be changed by moving or removing the retainer member 116. In some embodiments, the box receiving area 122 will be the same size as the space 114 by removing the retainer member 116 entirely. The face of the first retaining panel 118, configured to abut one side of box B, and the face of the second retaining panel 120, configured to abut another side of box B, together define a retaining corner 124 of the box receiving area 122. Two of the walls 108 define a dispensing corner 126 of the box receiving area 122 that is opposite the retaining corner 124. The dispensing opening 110 is disposed at or adjacent the dispensing corner 126 of the box receiving area 122.

The present disclosure contemplates a retainer member 116 that is configured to be adjustably disposed in the space 114 to vary the size and/or shape of the box receiving area 122. The retainer member 116 may be adjustably fixed to the base 102 (such as a slidable connection) so that its position on the support surface 112 may be changed, or the retainer member 116 may be removably connected to the base 102 (as shown in the illustrated embodiment) so that its position on the support surface 112 may be changed.

As shown in FIG. 1, the illustrated embodiment includes the retainer member 116 having a first projection 128 extending from the first retaining panel 118 and a second projection 130 extending from the second retaining panel 120. Other embodiments may include only one projection or may include more than two projections. In the illustrated embodiment, the projections 128, 130 are circular in cross-section. Other embodiments may include projections that have a different shaped cross-section including, for instance, semi-circular, rectangular, triangular, pentagonal, hexagonal, or the like.

As shown in FIGS. 1, 6, and 7, the base 102 includes at least one recess 132 defined therein. The cross-sectional shape of the recess 132 corresponds to the cross-sectional shape of the at least one projection (illustrated as first projection 128 and second projection 130). In the illustrated embodiment, the base 102 includes multiple pairs of recesses 132 to mount the retainer member 116 in different positions on the support surface 112. The retainer member 116 is placed on the base 102 with the first projection 128 removably received in one of the recesses 132 and the second projection 130 removably received in another of the recesses 132 to position the retainer member 116 in the space 114.

As shown in FIGS. 6 and 7, the plurality of recesses 132 allows the retainer member 116 to be placed in a variety of positions on the support surface 112 of the base 102. For example, FIG. 6 shows the retainer member 116 in a first position on the support surface 112 of the base 102. The retainer member 116 in the first position (FIG. 6), the support surface 112 of the base 102, and two of the walls 108 define the box receiving area 122 having a first width W1 and a first length L1. In another example, FIG. 7 shows the retainer member 116 in a second position on the support surface 112 of the base 102. The retainer member 116 in the second position (FIG. 7), the support surface 112, and two of the walls 108 define the box receiving area 122 having a second width W2 and a second length L2. In the illustrated examples, the first width W1 is greater than the second width W2, and the first length L1 is less than the second length L2. Other positions of the retainer member 116 are also available. For instance, the first and second positions of the retainer member 116 can be located such that the first width W1 and the second width W2 are equal. Alternatively, to illustrate another example, the first and second positions of the retainer member 116 can be located such that the first length L1 and the second length L2 are equal.

The recesses 132 can be provided in support surface 112 in a variety of positions and layouts so that the position of the retainer member 116 can be changed to define different sized and configured box receiving areas 122 and thereby accommodate boxes B of different sizes and configurations. Accordingly, a variety of different sized product boxes B can be positioned and removably held in place in the holder 100. For example, the first position shown in FIG. 6 is configured to hold a product box B1 that contains a product P having a relatively short length and, therefore, has a first length L1. The second position shown in FIG. 7 is configured to hold a product box B2 that contains a product P having a second length L2 longer than the first length L1.

Although the invention has been described in detail with reference to one or more preferred embodiments, variations and modifications exist within the scope and spirit of one or more independent aspects of the disclosure as described. Various features and advantages of the disclosure may be set forth in the following claims.

What is claimed is:

1. A dispensing box holder comprising:

a base;

a plurality of walls extending from the base, the plurality of walls including a first wall and a second wall;

a dispensing opening bounded by a first notch of the first wall and a second notch of the second wall, wherein the first notch and the second notch are contiguous with each other, the dispensing opening having two sides, one of the two sides of the dispensing opening facing a first direction and a second of the two sides of the dispensing opening facing a second direction different from the first direction, wherein both the first direction and the second direction are parallel to a plane defined by the base;

a retainer member configured to be removably received on the base to define a box receiving area with the base, the plurality of walls, and the retainer member, the retainer member including a first retaining face and a second retaining face, the first retaining face being opposed to and facing the first wall, the second retaining face being opposed to and facing the second wall; and wherein the retainer member defines two sides of the box receiving area with the retainer member mounted on the base.

2. The dispensing box holder of claim 1, wherein the base includes a recess defined therein; and the retainer member includes a projection configured to be removably received in the recess.

3. The dispensing box holder of claim 2, wherein the recess and the projection are both circular in cross-section.

4. The dispensing box holder of claim 1, wherein the base includes a plurality of recesses defined therein; and the retainer member includes a projection configured to be removably received in any one of the plurality of recesses.

5. The dispensing box holder of claim 4, wherein the projection is a first projection;

the retainer member further includes a second projection; and the first projection and the second projection are each configured to be removably received in respective recesses of the plurality of recesses.

6. The dispensing box holder of claim 1, wherein the retainer member is configured to be removably received on the base in a plurality of positions.

7. The dispensing box holder of claim 6, wherein the plurality of positions includes a first position and a second position;

the box receiving area defined by the base, the walls, and the retainer member with the retainer member in the first position is a first box receiving area having a first width and a first length;

the box receiving area defined by the base, the walls, and the retainer member with the retainer member in the second position is a second box receiving area having a second width and a second length; and at least one of the first width and the first length is different from one of the second width and the second length.

8. The dispensing box holder of claim 1, wherein the first retaining face and the second retaining face are configured to define a corner of the box receiving area.

9. The dispensing box holder of claim 8, wherein the first retaining face and the second retaining face are directly connected to each other.

10. A dispensing box holder comprising:

a base;

a plurality of walls extending from the base;

a space defined by the base and the plurality of walls;

a retainer member configured to be adjustably disposed in the space to define a box receiving area in the space with the base, the plurality of walls and the retainer member, the box receiving area including a dispensing corner defined by two adjacent perpendicular walls of the plurality of walls and a retaining corner opposite the dispensing corner; and a dispensing opening defined in the two adjacent perpendicular walls of the plurality of walls, the dispensing opening extending around the dispensing corner; and wherein the retainer member defines the retaining corner of the box receiving area.

11. The dispensing box holder of claim 10, wherein the retainer member includes a first retaining panel and a second retaining panel; and the first retaining panel and the second retaining panel define the retaining corner of the box receiving area.

12. The dispensing box holder of claim 11, wherein the first retaining panel and the second retaining panel are directly connected to each other.

13. The dispensing box holder of claim 11, wherein the retainer member further includes a first projection extending from the first retaining panel; and a second projection extending from the second retaining panel;

the base further includes a plurality of recesses defined therein; and the first projection and the second projection are each configured to be removably received in a respective recess of the plurality of recesses.

14. The dispensing box holder of claim 11, wherein the first retaining panel and the second retaining panel are perpendicular to each other.

15. The dispensing box holder of claim 10, wherein the retainer member is configured to be removable from the base.

16. The dispensing box holder of claim 10, wherein the retainer member is configured to be adjustable between a first position and a second position; and the retaining corner of the box receiving area is nearer the dispensing corner of the box receiving area in the first position than in the second position.

17. The dispensing box holder of claim 16, wherein the box receiving area is configurable to have a first width with the retainer member in the first position and a second width with the retainer member in the second position; and the first width is greater than the second width.

18. The dispensing box holder of claim 16, wherein the box receiving area is configurable to have a first length with the retainer member in the first position and a second length with the retainer member in the second position; and the first length is less than the second length.

19. The dispensing box holder of claim 10, wherein the box receiving area is configurable to have a first length and a first width with the retainer member in a first position and a second length and a second width with the retainer member in a second position; and the first length and the second length are different from one another and the first width and the second width are different from one another.

20. The dispensing box holder of claim 10, wherein the space includes an open end opposite the base.

21. A dispensing box holder comprising:

a base;

a plurality of walls extending from the base;

a space defined by the base and the plurality of walls;

a retainer member configured to be adjustably disposed in the space to define a box receiving area in the space with the base, the plurality of walls, and the retainer member, the box receiving area including a dispensing corner defined by two adjacent perpendicular walls of the plurality of walls and a retaining corner diagonally opposite the dispensing corner, the retaining corner defined by the retainer member; and a dispensing opening defined in the dispensing corner of the two adjacent perpendicular walls of the plurality of walls, the dispensing opening extending around the dispensing corner.

* * * * *